US008851631B2

(12) United States Patent
Kato et al.

(10) Patent No.: US 8,851,631 B2
(45) Date of Patent: Oct. 7, 2014

(54) LIQUID EJECTING HEAD AND LIQUID EJECTING APPARATUS

(75) Inventors: Jiro Kato, Suwa (JP); Ichiro Asaoka, Chino (JP); Mitsuhiro Wada, Chino (JP); Satoshi Denda, Suwa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/560,278

(22) Filed: Jul. 27, 2012

(65) Prior Publication Data

US 2013/0027470 A1 Jan. 31, 2013

(30) Foreign Application Priority Data

Jul. 29, 2011 (JP) ..... 2011-166461

(51) Int. Cl.
*B41J 2/14* (2006.01)
*B41J 2/16* (2006.01)

(52) U.S. Cl.
CPC ..... *B41J 2/14233* (2013.01); *B41J 2/1606* (2013.01); *B41J 2/1433* (2013.01)
USPC ..... 347/45

(58) Field of Classification Search
CPC ..... B41J 2/1606
See application file for complete search history.

(56) References Cited

U.S. PATENT DOCUMENTS

| | | | | |
|---|---|---|---|---|
| 6,312,103 | B1 * | 11/2001 | Haluzak | 347/45 |
| 2004/0223033 | A1 * | 11/2004 | Sasaki et al. | 347/45 |
| 2005/0057601 | A1 * | 3/2005 | Kojima et al. | 347/22 |
| 2005/0190231 | A1 * | 9/2005 | Lim et al. | 347/45 |
| 2006/0176341 | A1 * | 8/2006 | Juch et al. | 347/68 |
| 2006/0209135 | A1 * | 9/2006 | Hoisington et al. | 347/68 |
| 2007/0229597 | A1 * | 10/2007 | Kodama | 347/54 |
| 2008/0129780 | A1 * | 6/2008 | Cha et al. | 347/45 |
| 2010/0134560 | A1 * | 6/2010 | Doi et al. | 347/47 |
| 2011/0157278 | A1 * | 6/2011 | Gulvin et al. | 347/45 |
| 2011/0304671 | A1 * | 12/2011 | Law et al. | 347/44 |
| 2012/0268524 | A1 * | 10/2012 | Zhao et al. | 347/45 |
| 2012/0293586 | A1 * | 11/2012 | Law et al. | 347/54 |

FOREIGN PATENT DOCUMENTS

| | | |
|---|---|---|
| JP | 07-329303 | 12/1995 |
| JP | 2005-161679 | 6/2005 |

* cited by examiner

*Primary Examiner* — Shelby Fidler

(74) *Attorney, Agent, or Firm* — Harness, Dickey & Pierce, P.L.C.

(57) ABSTRACT

The liquid ejecting head includes a nozzle plate in which nozzle holes which are through holes are formed, and ejects liquid from the nozzle holes. The nozzle hole has a first nozzle portion which is opened to an ejection surface to which liquid is ejected from nozzles of the nozzle plate, and a second nozzle portion which communicates with the first nozzle portion, and is opened to a surface opposite to the ejection surface of the nozzle plate, and of which the opening diameter is larger than the opening diameter in the ejection surface of the first nozzle portion. The first nozzle portion is covered with a liquid repellent film which has higher liquid repellency than a base material of the nozzle plate and an inner wall of the second nozzle portion is provided with a region which has lower liquid repellency than the liquid repellent film.

16 Claims, 6 Drawing Sheets

LIQUID EJECTING HEAD AND LIQUID EJECTING APPARATUS

The entire disclosure of Japanese Patent Application No. 2011-166461, filed Jul. 29, 2011 is incorporated by reference herein.

BACKGROUND

1. Technical Field

The present invention relates to a liquid ejecting head and a liquid ejecting apparatus.

2. Related Art

In the related art, as an example of an ink jet type recording head which is a representative example of a liquid ejecting head to eject liquid drops, there is an ink jet type recording head which includes a flow path forming substrate in which plural pressure generating chambers are formed, piezoelectric actuators which are provided to correspond the respective pressure generating chambers on one surface of the flow path forming substrate, and a nozzle plate which is provided on the other surface of the flow path forming substrate and provides nozzle holes to communicate pressure generating chambers, and applies pressure to each pressure generating chamber by displacement of each piezoelectric actuator to eject ink drops from the nozzle holes.

In this manner, the ink drops are ejected from the nozzle hole so that for example, a hydrophilic film is formed in the nozzle hole to improve ejection characteristics of liquid. That is, the hydrophilic film is formed in the nozzle hole to increase wettability for ink. Thus, bubbles generated in the nozzle hardly adhere to an inner wall of the nozzle hole so that ink ejection defects in the nozzle hole are suppressed and ejection characteristics can be improved.

When the hydrophilic film is formed in such a nozzle hole, a water repellent film formation on an ejection surface of the nozzle plate is further known (refer to JP-A-2005-161679 (Claim 1 and the like)). In this case, the water repellent film is formed by plating so that the water repellent film is formed in a part of the ejection surface of the inner wall in the nozzle hole which is a through hole. By forming the water repellent film in this manner, ink does not adhere to the part, and unevenness in an ejection direction and ejection velocity of ink drop is suppressed.

However, in the structure disclosed in JP-A-2005-161679 (Claim 1 and the like), since the entire inner wall of the nozzle hole is hydrophilic and the inner wall has high wettability for ink. Therefore there is a problem that a large pressure is required when a meniscus moves in the nozzle hole to a vertical direction at the time of ejecting the ink. As described above, since the inner wall has high wettability for ink, the meniscus disposed on the inner wall at the time of ejecting the ink is easily influenced by the inner wall. Thus, there is a problem that flight deflection easily occurs.

Even when the water repellent film is formed only around an opening of the nozzle hole, the meniscus is finally disposed on a surface having high wettability for ink where the hydrophilic film is formed. Thus, it is considerable that a large pressure is required when a meniscus moves in the nozzle hole to the vertical direction at the time of ejecting the ink to lower ejection efficiency and flight deflection occurs and thereby liquid ejection characteristics are lowered.

SUMMARY

An advantage of some aspects of the invention is to provide a liquid ejecting head and a liquid ejecting apparatus to improve ejection efficiency and liquid ejection characteristics.

According to an aspect of the invention, there is provided a liquid ejecting head including a nozzle plate in which nozzle holes are formed. Each of the nozzle hole has a first nozzle portion which is opened to an ejection surface to eject liquid, and a second nozzle portion which communicates with the first nozzle portion and has a larger internal diameter than the first nozzle portion. A liquid repellent film having higher liquid repellency than a base material of the nozzle plate is formed on an entire inner wall surface of the first nozzle portion, and at least a part of an inner wall surface of the second nozzle portion has lower liquid repellency than the liquid repellent film.

In the liquid ejecting head, since the entire inner wall surface of the first nozzle portion is covered with the liquid repellent film having higher liquid repellency than the base material of the nozzle plate, it is possible to improve pressure applying efficiency. In addition, by covering the entire inner wall surface of the first nozzle portion with the liquid repellent film having higher liquid repellency than the base material of the nozzle plate, a meniscus disposed on the inner wall at the time of ejecting the ink is hardly influenced by the inner wall and flight deflection hardly occurs. Furthermore, since at least a part of the inner wall surface of the second nozzle portion has lower liquid repellency than the liquid repellent film, it is possible to suppress bubbles from adhering. Accordingly, the liquid ejecting head according to the aspect of the invention improves ejection efficiency and liquid ejection characteristics. Here, the liquid repellency means both oil repellency and water repellency for liquid ejected from an ink jet type recording head.

In the liquid ejecting head, it is preferable that the entire inner wall surface of the second nozzle portion have lower liquid repellency than the liquid repellent film or the liquid repellent film extend to at least a part of the second nozzle portion. With such a configuration, since the liquid repellency of the second nozzle portion is lower than that of the first nozzle portion, it is possible to further suppress bubbles from adhering.

In the liquid ejecting head, it is preferable that a lyophilic film having higher lyophilic properties than the base material of the nozzle plate be formed on at least a part of the inner wall surface of the second nozzle portion. By forming the lyophilic film, it is possible to further suppress bubbles from adhering. Here, the lyophilic properties mean both oleophilic properties and hydrophilic properties for the liquid ejected from the ink jet type recording head.

In the liquid ejecting head, it is preferable that the second nozzle portion be longer than the first nozzle portion.

In the liquid ejecting head, it is preferable that the first nozzle portion be linearly provided to an ejection direction of liquid from the nozzle holes.

In the liquid ejecting head, it is preferable that the second nozzle portion be provided in a tapered shape in which the diameter becomes narrower in the ejection direction of the liquid from the nozzle holes or the second nozzle portion be linearly provided to the ejection direction of the liquid from the nozzle holes.

In the liquid ejecting head, it is preferable that irregularities be formed on the inner wall surface of the first nozzle portion. Due to this, liquid repellency can be improved.

According to another aspect of the invention, there is provided a liquid ejecting apparatus including the liquid ejecting head according to any of the above-described aspects. By including the liquid ejecting head according to any of the above aspects in which ejection efficiency and liquid ejection characteristics are improved, liquid ejection characteristics are improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
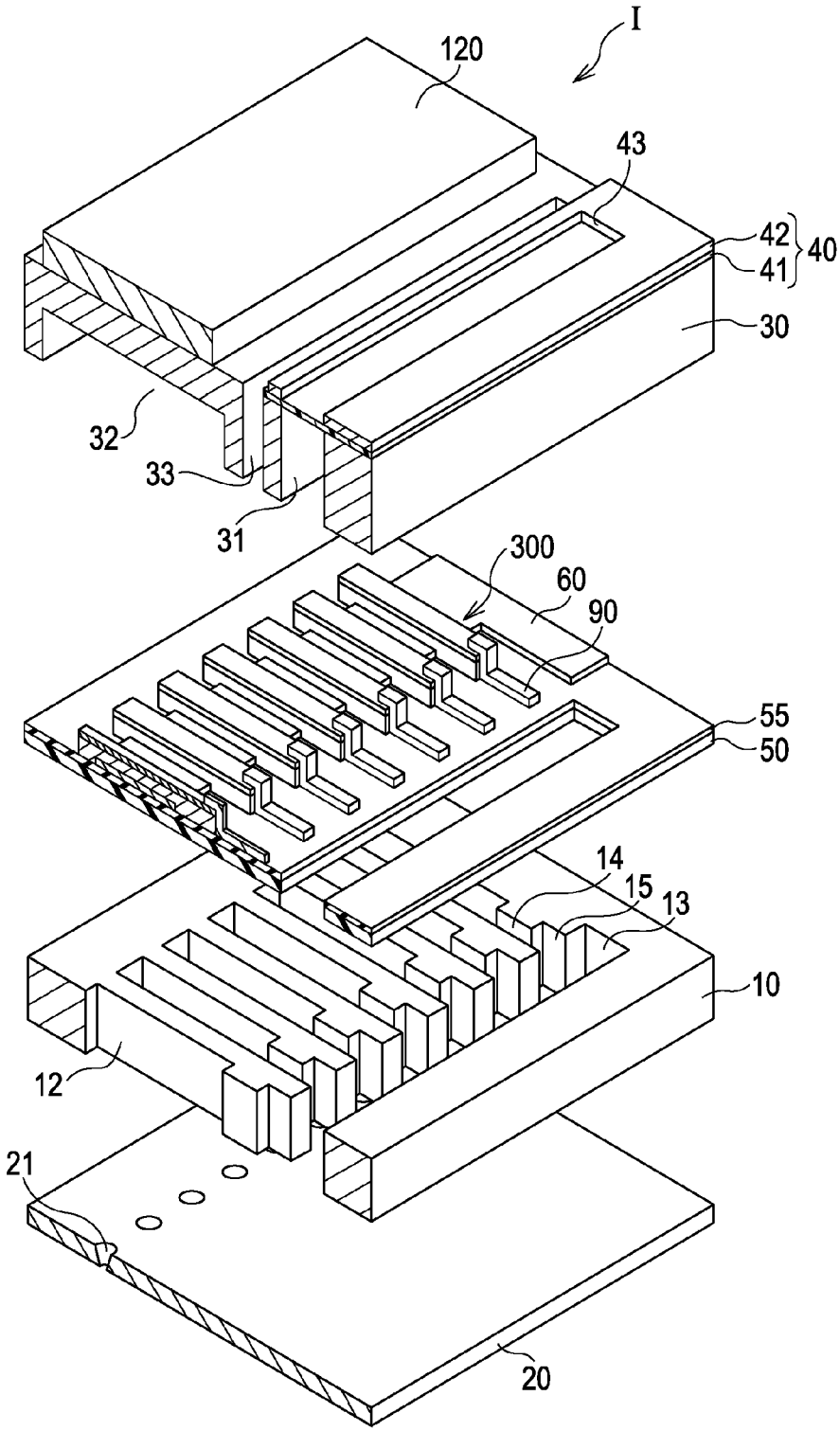
FIG. 1 is an exploded perspective view showing a recording head according to a first embodiment.
Figure 2A:
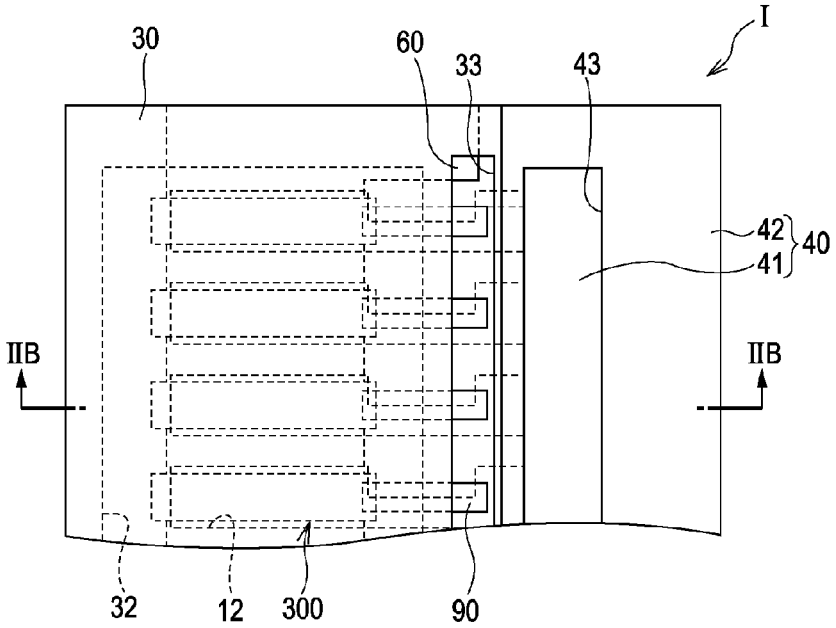
FIG. 2A is a plane view showing the recording head according to the first embodiment.
Figure 2B:
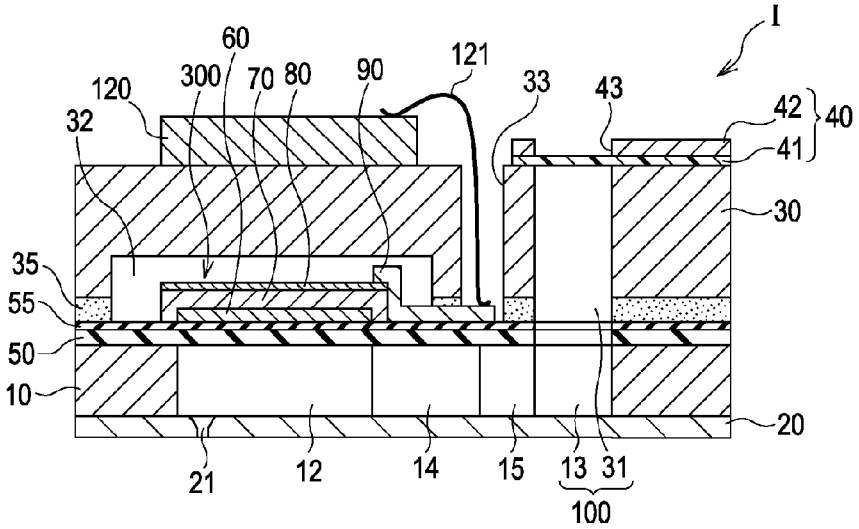
FIG. 2B is a cross-sectional view showing the recording head according to the first embodiment.

FIG. 1 is an exploded perspective view showing a schematic configuration of an ink jet type recording head according to a first embodiment of the invention and FIGS. 2A and 2B are a plane view and a cross-sectional view of the recording head 1 cut along a line IIB-IIB.

As shown in the drawings, a flow path forming substrate 10 is made of a silicon monocrystalline substrate and an elastic film 50 made of is silicon dioxide is formed on one surface thereof.

Plural pressure generating chambers 12 are arranged in the flow path forming substrate 10. In addition, a communicating unit 13 is formed in an outer region in a direction orthogonal to the arranged direction of the pressure generating chambers 12 in the flow path forming substrate 10, and the communicating unit 13 and each pressure generating chamber 12 communicate through an ink supply path 14 and a communication path 15 provided in every pressure generating chamber 12. The communicating unit 13 communicates a manifold unit 31 on a protective substrate which is described later to configure a part of the manifold which is a common ink chamber of each pressure generating chamber 12. The ink supply path 14 is formed with a width narrower than that of the pressure generating chamber 12, and maintains flow path resistance of ink which flows from the communicating unit 13 to the pressure generating chamber 12 constant.

A nozzle plate 20 where a nozzle hole 21 which is a through hole to communicate with the vicinity of an end opposite to the ink supply path 14 in each pressure generating chamber 12 is drilled is fixed on an opening surface of the flow path forming substrate 10 by an adhesive, a thermal welding film, and the like. The nozzle plate 20 is made of, for example, glass ceramics, a silicon monocrystalline substrate, and stainless steel. The nozzle plate 20 and the nozzle hole 21 will be described later in detail.

As described above, the elastic film 50 is formed on the opposite side of the opening surface of the flow path forming substrate 10. An insulator layer 55 made of zirconium oxide is formed on the elastic film 50. Furthermore, a first electrode 60, a piezoelectric layer 70, and a second electrode 80 are laminated on the insulator layer 55 in a production method which will be described later to form a piezoelectric element 300. The piezoelectric element 300 means a portion that includes the first electrode 60, the piezoelectric layer 70, and the second electrode 80. Generally, any one electrode of the piezoelectric element 300 is set as a common electrode and patterning of other electrode and the piezoelectric layer 70 is performed in every pressure generating chamber 12. In the embodiment, the first electrode 60 is set as the common electrode of the piezoelectric element 300 and the second electrodes 80 are set as individual electrodes of the piezoelectric elements 300. However, by virtue of the driving circuit and wiring, there are no problems even when this is reversed. Here, the piezoelectric element 300 and a vibrating plate in which displacement is generated by driving the piezoelectric element 300 are collectively called an actuator. In the embodiment, the elastic film 50, the insulator layer 55 and the first electrode 60 work as a vibrating plate, but it is not limited to this. For example, only the first electrode 60 may work as a vibrating plate without the elastic film 50 and the insulator layer 55. Additionally, the piezoelectric element 300 itself may practically work as a vibrating plate.

The first electrode 60 is made of a metal selected from a group consisting of platinum group metals such as iridium (Ir), platinum (Pt) and palladium (Pd) and gold (Au) and has plural laminated layers.

The piezoelectric layer 70 is formed on the first electrode 60 and is made of piezoelectric material which shows electromechanical conversion action. The piezoelectric layer 70 is obtained by laminating a piezoelectric film which is a crystalline film with a perovskite structure and includes at least Pb, Ti and Zr. In the embodiment, lead zirconate titanate is used.

Lead electrodes 90 which are drawn out from the vicinity of the ends of the ink supply paths 14, extend to the insulator film 55, and are made of gold (Au), for example, are connected to the respective second electrodes 80 that are the individual electrodes of the piezoelectric elements 300.

A protective substrate 30 which has a manifold unit 31 configuring at least a part of a manifold 100 is bonded on the flow path forming substrate 10 on which the piezoelectric elements 300 are formed, that is, on the first electrode 60, the insulator layer 55 and the lead electrodes 90 by an adhesive 35. The manifold unit 31 passes through the protective substrate 30 in a thickness direction and is formed in a width direction of the pressure generating chambers 12 in the embodiment. As described above, the manifold unit 31 communicates with the communicating unit 13 of the flow path forming substrate 10 to form the manifold 100 which is the common ink chamber of each pressure generating chamber 12.

A piezoelectric element protection unit 32 which has a space of the degree which does not interrupt movement of the piezoelectric elements 300 is provided in a region facing the piezoelectric elements 300 of the protective substrate 30. The piezoelectric element protection unit 32 may be sealed or not be sealed as long as the space of the degree which does not interrupt movement of the piezoelectric elements 300 is provided.

As the protective substrate 30, it is preferable to use material which has approximately the same coefficient of thermal expansion as the flow path forming substrate 10, for example, glass and ceramics, and in the embodiment, to use the silicon monocrystalline substrate which is the same material as the flow path forming substrate 10.

A through hole 33 which passes through the protective substrate 30 in the thickness direction is provided in the protective substrate 30. The vicinity of the ends in the lead electrodes 90 which are drawn out from each piezoelectric element 300 is provided so that the inside of the through hole 33 is exposed.

A driving circuit 120 to drive the arranged piezoelectric elements 300 is fixed on the protective substrate 30. As the driving circuit 120, it is possible to use a circuit substrate and a semiconductor integrated circuit (IC), for example. The driving circuit 120 and the lead electrodes 90 are electrically connected to each other through connecting wiring 121 made of a conductive wire such as a bonding wire.

A compliance substrate 40 made of a sealing film 41 and a stationary plate 42 are bonded to the protective substrate 30. The sealing film 41 is made of material having low rigidity and flexibility, and one surface of the manifold unit 31 is sealed by the sealing film 41. The stationary plate 42 is made of relatively hard material. Since an opening 43 where the stationary plate 42 is completely removed in the thickness direction is formed in a region of the stationary plate 42 facing the manifold 100, the one surface of the manifold 100 is sealed only by the sealing film 41 having flexibility.

In the ink jet type recording head according to the embodiment, the ink is fed from an ink feed port connected to an outside ink supply unit (not shown), the inside from the manifold 100 to the nozzle holes 21 is filled with the ink. Then, a voltage is applied between the first electrode 60 and the second electrodes 80 corresponding to the pressure generating chambers 12 according to a recording signal from the driving circuit 120 and the elastic film 50, the insulator layer 55, the first electrode 60, and the piezoelectric layer 70, are deflected to increase pressure in each pressure generating chamber 12, thereby ejecting ink drops from the nozzle holes 21.

Figure 3:
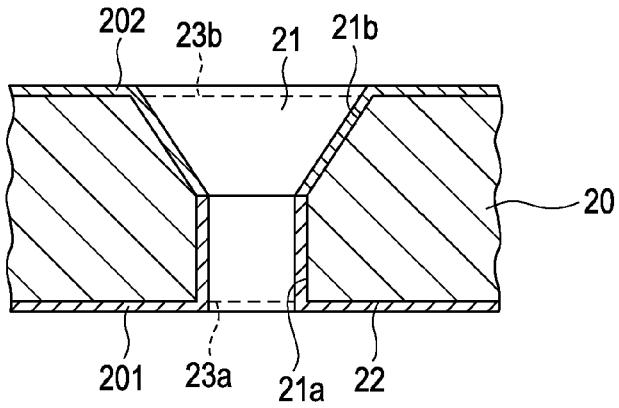
FIG. 3 is a cross-sectional view showing a part of a nozzle plate according to the first embodiment.

The nozzle plate 20 used in the ink jet type recording head according to the embodiment is described with reference to FIG. 3. FIG. 3 is a cross-sectional view of enlarging a part of the nozzle plate 20.

As shown in FIG. 3, the nozzle hole 21 formed on the nozzle plate 20 has a first nozzle portion 21*a* which is opened to an ejection surface 22 of the nozzle plate 20 and a second nozzle portion 21*b* which is opened to an opposite surface to the ejection surface 22 of the nozzle plate 20 (the opening surface of the flow path forming substrate). The first nozzle portion 21*a* communicates with the second nozzle portion 21*b* to form the nozzle hole 21 which is a through hole.

The first nozzle portion 21*a* has an identical internal diameter (is linear to an ejection direction) in a vertical direction to the opening surface (an axial direction), that is, is formed in a cylindrical space. Since the first nozzle portion 21*a* is formed in such cylindrical space, it is possible to suppress unevenness of ejection characteristics by process errors at the time of forming the nozzle hole 21.

Figure 4A:
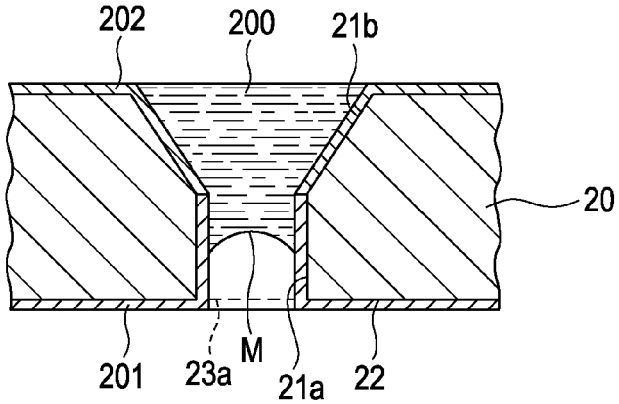
FIGS. 4A to 4C are cross-sectional views showing a part of the nozzle plate according to the first embodiment.
Figure 4B:
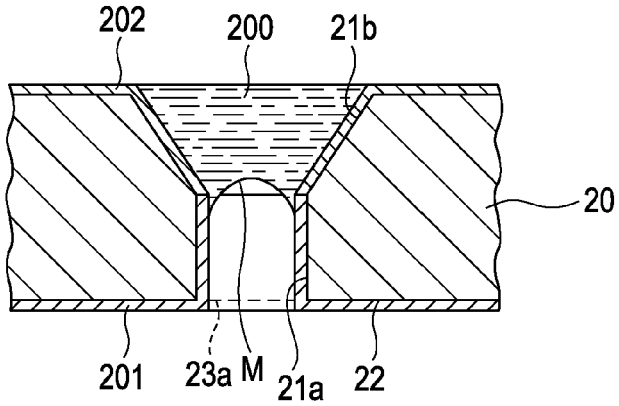
Figure 4C:
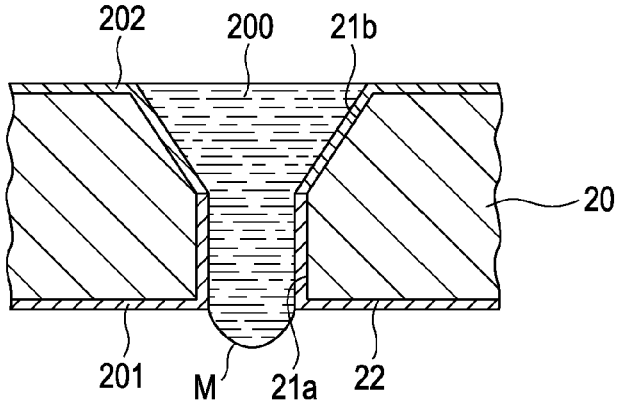

The first nozzle portion 21*a* is a region where a meniscus M is formed when the ink is filled as shown in FIG. 4A. The meniscus M once moves the axial direction of the first nozzle portion 21*a* to the pressure generating chamber at the time of ejection, as shown in FIG. 4B, and moves the axial direction of the first nozzle portion 21*a* to the ejection surface 22 as shown in FIG. 4C to be ejected. In such a manner, the meniscus M moves in the axial direction of the first nozzle portion 21*a*. Since the first nozzle portion 21*a* is formed in the cylindrical space, it is possible to move the meniscus M by applying a predetermined pressure to the meniscus M at the time of ejection. Due to this, unevenness of ejection characteristics in each nozzle hole can be suppressed.

A second opening 23*b* of the second nozzle portion 21*b* has a larger diameter than a first opening 23*a* of the first nozzle portion 21*a*. In the second nozzle portion 21*b*, the diameter becomes smaller from the second opening 23*b* to the first nozzle portion 21*a*, that is, to the liquid ejection direction.

In the nozzle plate 20 according to the embodiment, a liquid repellent film 201 is formed so as to cover the ejection surface 22 and the entire inner wall surface of the first nozzle portion 21*a* and a lyophilic film 202 is formed so as to cover the entire inner wall surface of the second nozzle portion 21*b*. Here, the liquid repellency means both oil repellency and water repellency for liquid ejected from the ink jet type recording head. In other words, the liquid repellency means oil repellency for the liquid ejected from the ink jet type recording head of which the main component in a solution (mainly a solvent) is oil, and water repellency for the liquid ejected from the ink jet type recording head of which the main component in the solution (mainly the solvent) is water. The liquid repellent film 201 has higher liquid repellency than the base material of the nozzle plate 20.

On the contrary, lyophilic properties mean both oleophilic properties and hydrophilic properties for the liquid ejected from the ink jet type recording head. In other words, the lyophilic properties mean oleophilic properties for the liquid ejected from the ink jet type recording head of which the main component in the solution (mainly the solvent) is oil, and hydrophilic properties for the liquid ejected from the ink jet type recording head of which the main component in the solution (mainly the solvent) is water. The lyophilic film 202 has higher lyophilic properties than the base material of the nozzle plate 20.

A fluorine-based polymer including elastomers can be exemplified as a material that has high water repellency and oil repellency. As the fluorine-based polymer, fluorocarbon, perfluorocarbon, fluoroalkylsilane, perfluoroalkylsilane, alkylpyrrole, polytetrafluoroethylene, chlorotrifluoroethylene, vinylidene fluoride, polyvinyl fluoride, perfluoroalkoxy fluoride, tetrafluoroethylene-hexafluoropropylene copolymers, ethylene tetrafluoroethylene copolymers, ethylene chlorotrifluoroethylene copolymers, polyperfluoroalkoxy butadiene, polyfluorovinylidene, polyfluorovinyl, polydiperfluoroalkyl fumarate, perfluoro elastomers, and FLUOROSURF, trade name, manufactured by Fluoro Technology Co., Ltd. can be exemplified.

As material which has high oil repellency and low water repellency, metal and a metal oxide can be exemplified. As the metal oxide, an oxide film which is formed on the outermost surface made of SUS, titania, silicon oxide ($SiO_2$), alumina, nickel oxide, and the like is preferable. Since a polymeric material has high oil repellency and low water repellency, compatibility with water is too high. Therefore, it is preferable for an organic polymer (OH group and the like) to be used in the nozzle hole 21 since the organic polymer is partially dissolved and swollen.

As material which has water repellency and low oil repellency, organic polymers such as a silicon-based polymer including elastomers and a cellulose-based polymer including elastomers can be exemplified.

Therefore, an appropriate and suitable material may be chosen according to ink characteristics as the liquid repellent film 201 and the lyophilic film 202.

In the embodiment, since the entire inner wall surface of the first nozzle portion 21*a* is covered with the liquid repellent film 201 as described above, wettability for ink is low in the first nozzle portion 21*a* which is the movement region of the meniscus at the time of ejecting the ink. Due to this, the pressure applied to move the meniscus M may be small and applying efficiency of the pressure applied to the meniscus M by driving the piezoelectric elements is favorable.

Since the entire inner wall surface of the first nozzle portion 21*a* is covered with the liquid repellent film 201 which has low wettability for ink in the case, a contact angle of the meniscus M formed in the first nozzle portion 21*a* which is the movement region of the meniscus M is small. The area of the formed meniscus M is reduced, ink drying rate is decreased and ejection defects (for example, clogging of the nozzle hole by drying the ink and flight deflection due to foreign substance formation by drying the ink) by drying the ink hardly occur.

Figure 5:
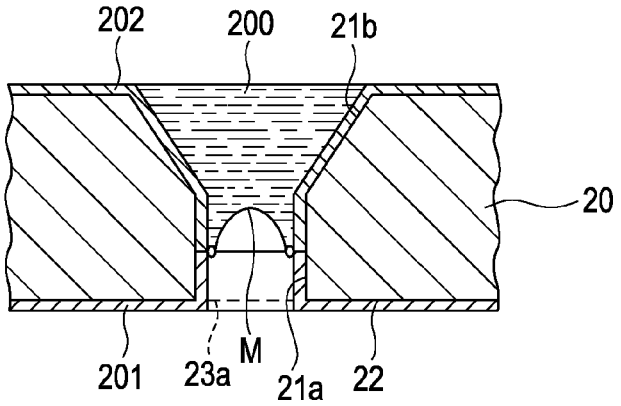
FIG. 5 is a cross-sectional view showing a part of a nozzle plate in the related art.

In the related example in FIG. 5, when the liquid repellent film 201 is provided only in the opening side of the first nozzle portion 21*a* (in a depth direction of about 7 μm), and the lyophilic film 202 is formed on the rest of the first nozzle portion 21*a* and the second nozzle portion 21*b*, a lager voltage is applied than the case shown in FIGS. 4A to 4C by moving the meniscus M to the region in which the lyophilic film 202 is formed at the time of ejection and the pressure applying efficiency is lowered.

The lyophilic film 202 which has high wettability for ink is formed in the first nozzle portion 21*a* other than the vicinity of the opening 23*a* thereof, the contact angle of the meniscus M is bigger than that of the meniscus shown in FIGS. 4A to 4C. Due to this, the ink easily dries and foreign substances are easily formed. In this case, foreign substances are more easily formed at the boundary between the liquid repellent film 201 and the lyophilic film 202. Moreover, since such boundary is disposed around the opening, the ink dries easily and foreign substances are particularly easily formed. When the foreign substances are in the first nozzle portion 21*a* in such a manner, the ejection defects like flight deflection are problematic. On the contrary, it is difficult for ejection defects to occur in the entire inner wall of the first nozzle portion 21*a* by forming the liquid repellent film 201 as described above in the embodiment.

It is considerable that when the liquid repellent film 201 is formed on the entire inner wall surface of the second nozzle portion 21*b* in other side, bubbles easily adhere to the second nozzle portion 21*b*, and the bubbles are gathered together and becomes very large, causing ejection defects. Accordingly, a region which has lower liquid repellency than at least the first nozzle portion 21*a* may be provided on the inner wall surface of the second nozzle portion 21*b*. It is possible to suppress the bubbles from adhering by providing the region which has lower liquid repellency in this manner.

In the embodiment, since the liquid repellent film 201 is formed on the entire inner wall surface of the first nozzle portion 21*a* to suppress the pressure applying efficiency from lowering, the ejection efficiency is improved and the adhesion of the foreign substances is prevented to suppress ejection defects like flight deflection. Moreover, the lyophilic film 202 is formed on the entire inner wall surface of the second nozzle portion 21*b* to suppress the bubbles from adhering and ejection defects like flight deflection are suppressed to improve liquid ejection characteristics.

As a production method of the nozzle plate in the invention, for example, the liquid repellent film 201 is formed on the whole nozzle plate 20, that is, the whole nozzle plate including the inner walls of the nozzle holes 21 by dipping. As the production method of the nozzle plate, in addition, a dry process such as a CVD method, a deposition method, and a sputtering method may be used.

For example, by performing a plasma process from the opposite surface to the ejection surface 22 of the nozzle plate 20, the liquid repellent film adhered to the inner wall of the second nozzle portion 21*b* is removed and a surface of the second nozzle portion 21*b* is exposed. The liquid repellent film may be removed by an exposure process using visible light, UV light, and X rays rather than by the plasma process.

Then, the lyophilic film 202 is formed on the inner wall of the second nozzle portion 21*b* from the surface of the second nozzle portion 21*b* side by a sputtering method or a deposition method, for example. It is possible to form the nozzle plate 20 of the invention in such a manner. The production method of the nozzle plate 20 is not limited to this.

Figure 6:
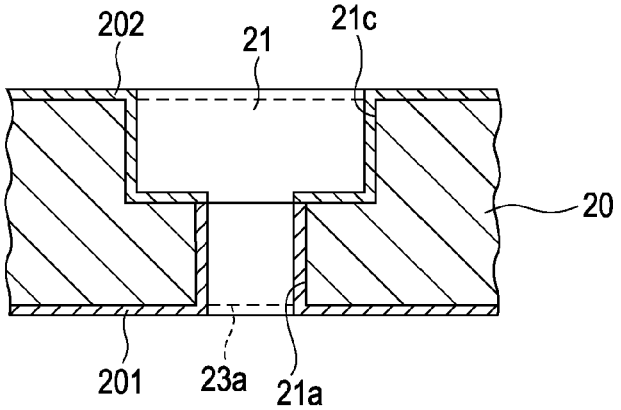
FIG. 6 is a cross-sectional view showing a part of a nozzle plate according to another embodiment.

As shown in FIG. 6, a nozzle plate which is different from the embodiment shown in FIG. 3 in the point that an internal diameter of a second nozzle portion 21*c* is the same as that of another embodiment of the invention. That is, the nozzle hole 21 is provided with the first nozzle portion 21*a* having a different internal diameter, and the second nozzle portion 21*c*. Even in this case, the entire inner wall surface of the first nozzle portion 21*a* is covered with the liquid repellent film 201, and the entire inner wall surface of the second nozzle portion 21*c* is covered with the lyophilic film 202. Even when the shape of the nozzle hole 21 is different, the liquid repellent film 201 is formed in the first nozzle portion 21*a* which is the movement region of the meniscus and the lyophilic film 202 is formed in the second nozzle portion 21*c*. Therefore ink ejection efficiency and ejection characteristics are favorable like the embodiment shown in FIG. 3.

Figure 7:
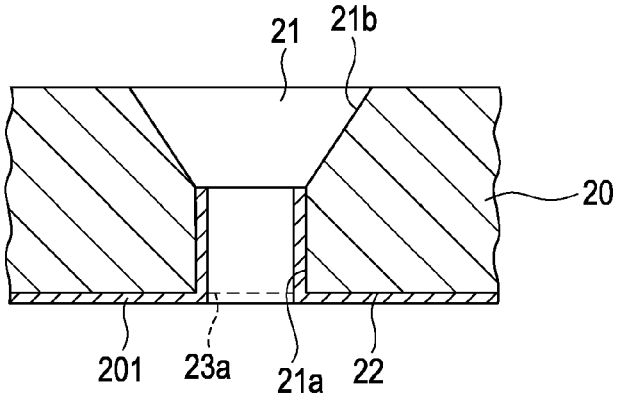
FIG. 7 is a cross-sectional view showing a part of a nozzle plate according to another embodiment.

As another embodiment of the invention, a nozzle plate which is different from the embodiment shown in FIG. 3 in the point that the lyophilic film 202 is formed as shown in FIG. 7. Even in this case, when the inner wall of the second nozzle portion 21*b* itself, that is, the base material of the nozzle plate 20 has lower liquid repellency than the liquid repellent film 201, bubbles hardly adhere to the inner wall. Therefore ejection characteristics are favorable.

In other words, the region which has lower liquid repellency than at least the first nozzle portion 21*a* as described above may be provided in the second nozzle portion 21*b*. In the embodiment shown in FIG. 3, the region which has low liquid repellency is provided in the second nozzle portion 21*b* by forming the hydrophilic film in the second nozzle portion 21*b*. However, the base material of the nozzle plate 20 having lower liquid repellency than the liquid repellency in the second nozzle portion 21*b* is exposed so that the region which has low liquid repellency is provided in the second nozzle portion 21*b* in the embodiment shown in FIG. 7.

When the base material of the nozzle plate 20 itself has higher lyophilic properties than the liquid repellent film 201, it is possible to improve ejection efficiency and ejection characteristics without forming a film having high lyophilic properties. In this case, when the liquid is water-based ink, material which is used as a usual nozzle plate like SUS and silicon can be exemplified as the material which has relatively high lyophilic properties and can be used as the nozzle plate 20.

Figure 8:
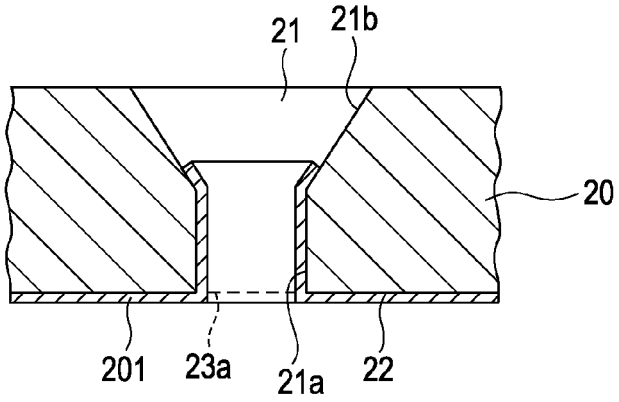
FIG. 8 is a cross-sectional view showing a part of a nozzle plate according to another embodiment.

Furthermore, another embodiment of the invention is different from the embodiment shown in FIG. 7 in the point that the liquid repellent film 201 extends to the second nozzle portion 21*b* as shown in FIG. 8. Even in this case, the liquid repellent film 201 does not cover the whole second nozzle portion 21*b*, and the region where the liquid repellent film 201 is not formed and the base material is exposed, and which has lower liquid repellency than the liquid repellent film 201 is provided in the second nozzle portion 21*b*. When the liquid repellent film 201 covers the whole second nozzle portion 21*b*, bubbles come to easily stay as described above. That is, it is preferable that the liquid repellent film 201 be configured to cover only the first nozzle portion 21*a* as much as possible. However, the second nozzle portion 21*b* of the first nozzle portion 21*a* side may be covered with the liquid repellent film 201 like the embodiment.

For example, when a film made of a fluorine-based polymer is formed as the liquid repellent film 201 in the embodiments shown in the FIGS. 7 and 8, the outermost surface of the nozzle hole 21 is $SiO_2$. Therefore, lyophilic properties are high.

Figure 9:
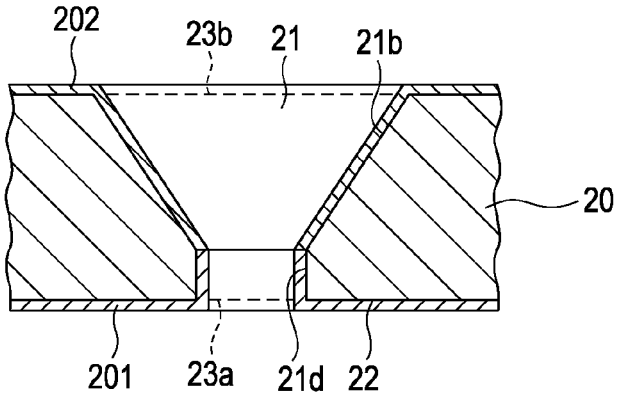
FIG. 9 is a cross-sectional view showing a part of a nozzle plate according to another embodiment.

As shown in FIG. 9, the length of the first nozzle portion in the embodiment shown in FIG. 3 may be changed. In other words, in FIG. 9, a first nozzle portion 21*d* is shorter than the first nozzle portion of the embodiment shown in FIG. 3. In such configuration, since flow path resistance of the first nozzle portion 21*d* can be decreased, ink having high viscosity can be used. Even in this case, since the liquid repellent film 201 is configured to cover the first nozzle portion 21*d* and the lyophilic film 202 is configured to cover the second nozzle portion 21*b*, ejection characteristics and applying efficiency of the ink jet type recording head are favorable.

As described in each embodiment, the entire inner wall of the first nozzle portion 21*a* may be covered with at least the liquid repellent film 201 in the nozzle plate 20. The second nozzle portion 21*b* or 21*c* may be formed irrespective of the shape, but the entire surface of the second nozzle portion 21*b* or 21*c* may be formed in a state in which lyophilic properties of the entire surface are higher than the liquid repellent film 201. By having this configuration, ejection characteristics and applying efficiency of the ink jet type recording head are favorable.

When liquid repellency, that is, water repellency and oil repellency need to be improved, irregularities are formed on the surface of the liquid repellent film 201 to increase the surface area. Thus, it is possible to remarkably increase the water repellency and the oil repellency of the liquid repellent film 201. For example, when the surface of the liquid repellent film is formed to have a fractal structure to maximize an area of a contact surface with liquid in imitation of a surface structure like a lotus leaf and a rose petal, the surface area increases in comparison with a plane surface to improve water repellency and oil repellency. As a method of forming irregularities, when the nozzle plate 20 is a silicon nozzle plate, a BOSCH process can be exemplified. When the nozzle holes are formed by the BOSCH process, micro irregularities under 1 μm can be provided in the nozzle holes. When the liquid repellent film 201 is formed on the irregularities, the surface of the liquid repellent film 201 is provided with the irregularities to improve water repellency and oil repellency.

Figure 10:
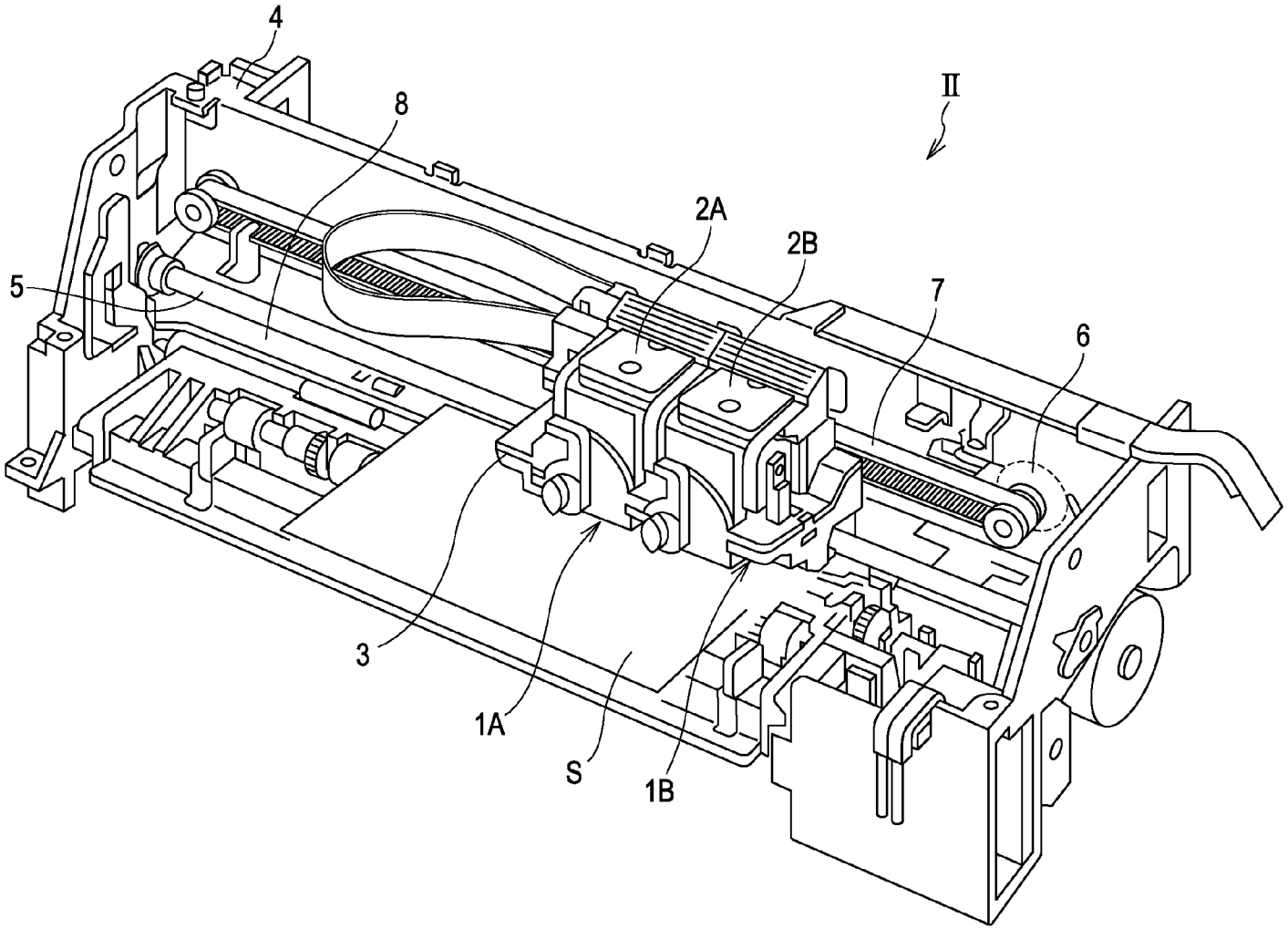
FIG. 10 is a view showing a schematic configuration of a recording apparatus according to an embodiment.

The liquid recording head described above is mounted in an ink jet recording apparatus. FIG. 10 is a schematic view showing an example of the ink jet recording apparatus.

Recording head units 1A and 1B having ink jet type recording heads I are detachably provided with cartridges 2A and 2B which configure an ink supply unit, and a carriage 3 in which the recording head units 1A and 1B are mounted is provided on a carriage axis 5 which is attached to a main body 4 to move in an axis direction. For example, the recording head units 1A and 1B respectively eject black ink composition and color ink composition.

Driving force of a driving motor 6 is transmitted to the carriage 3 through plural gears (not shown) and a timing belt 7 so that the carriage 3 in which the recording head units 1A and 1B are mounted moves along the carriage axis 5. Meanwhile, a platen 8 is provided in the main body 4 along the carriage axis 5, and a recording sheet S which is a recording medium such as paper fed by a feed roller (not shown) or the like is wound around the platen 8 to be transported.

In the embodiment, the ink jet type recording head has been described as an example of a liquid ejecting head that may be used in association with the invention. However, the invention can be widely applied not only to every kind of liquid ejecting heads and liquid ejecting apparatuses equipped thereof, but also to liquid ejecting heads which eject liquid other than ink and liquid ejecting apparatuses equipped thereof. As a liquid ejecting head, various kinds of recording heads used in image recording apparatuses such as a printer, color material ejecting apparatuses used for producing color filters of liquid crystal displays or the like, electrode material ejecting apparatuses used for forming electrodes of organic EL displays, field emission displays (FEDs), or the like, and bio-organic material ejecting apparatuses used for producing bio-chips.

What is claimed is:

1. A liquid ejecting head comprising:

a one-piece nozzle plate in which nozzle holes are formed, wherein each of the nozzle holes has a first nozzle portion which is opened to an ejection surface to eject liquid, and a second nozzle portion which communicates with the first nozzle portion and has a larger internal diameter than the first nozzle portion, and a liquid repellent film having higher liquid repellency than a base material of the nozzle plate is formed on an entire inner wall surface of the first nozzle portion, and at least a part of an inner wall surface of the second nozzle portion has lower liquid repellency than the liquid repellent film, wherein irregularities are formed on the inner wall surface of the first nozzle portion, and the surface of the liquid repellent film is provided with the irregularities.

2. The liquid ejecting head according to claim 1, wherein the entire inner wall surface of the second nozzle portion has lower liquid repellency than the liquid repellent film.

3. The liquid ejecting head according to claim 1, wherein the liquid repellent film extends to at least a part of the second nozzle portion.

4. The liquid ejecting head according to claim 1, wherein a lyophilic film having higher lyophilic properties than the base material of the nozzle plate is formed on at least a part of the inner wall surface of the second nozzle portion.

5. The liquid ejecting head according to claim 1, wherein the second nozzle portion is longer than the first nozzle portion.

6. The liquid ejecting head according to claim 1, wherein the first nozzle portion is linearly provided in an ejection direction of liquid from the nozzle holes.

7. The liquid ejecting head according to claim 1, wherein the second nozzle portion is provided in a tapered shape in which a diameter becomes narrower in the ejection direction of the liquid from the nozzle holes.

8. The liquid ejecting head according to claim 1, wherein the second nozzle portion is linearly provided to the ejection direction of the liquid from the nozzle holes.

9. A liquid ejecting apparatus comprising the liquid ejecting head according to claim 1.

10. A liquid ejecting apparatus comprising the liquid ejecting head according to claim 2.

11. A liquid ejecting apparatus comprising the liquid ejecting head according to claim 3.

12. A liquid ejecting apparatus comprising the liquid ejecting head according to claim 4.

13. A liquid ejecting apparatus comprising the liquid ejecting head according to claim 5.

14. A liquid ejecting apparatus comprising the liquid ejecting head according to claim 6.

15. A liquid ejecting apparatus comprising the liquid ejecting head according to claim 7.

16. A liquid ejecting apparatus comprising the liquid ejecting head according to claim 8.

* * * * *